US007533475B2

(12) United States Patent
Garneau

(10) Patent No.: US 7,533,475 B2
(45) **Date of Patent: *May 19, 2009**

(54) BICYCLE SHOE WITH VENTILATING SOLE

(75) Inventor: Louis Garneau, St-Augustin-de-Desmaures (CA)

(73) Assignee: Louis Garneau Sports Inc., St-Augustin-de-Desmaures (QC) (CA)

( * ) Notice: Subject to any disclaimer, the term of this patent is extended or adjusted under 35 U.S.C. 154(b) by 579 days.

This patent is subject to a terminal disclaimer.

(21) Appl. No.: 11/260,461

(22) Filed: Oct. 28, 2005

(65) Prior Publication Data

US 2006/0059724 A1 Mar. 23, 2006

Related U.S. Application Data

(63) Continuation of application No. 10/209,003, filed on Aug. 1, 2002, now Pat. No. 6,990,752.

(51) Int. Cl.
*A43B 7/06* (2006.01)
*A43B 7/08* (2006.01)
*A43B 5/14* (2006.01)

(52) U.S. Cl. ..... 36/3 R; 36/131; 36/30 R; 36/29

(58) Field of Classification Search ..... 36/3 R, 36/3 B, 131, 29, 43, 30 R
See application file for complete search history.

(56) References Cited

U.S. PATENT DOCUMENTS 2,292,318 A 8/1942 Daly
3,012,342 A 12/1961 Ramirez
3,426,455 A 2/1969 Drago
4,078,321 A 3/1978 Famolare
4,100,685 A 7/1978 Dassler
4,102,061 A 7/1978 Saaristo
4,246,708 A 1/1981 Gladek
4,290,211 A 9/1981 Csengeri
4,438,573 A 3/1984 McBarron
4,679,335 A 7/1987 Berlese
4,813,160 A 3/1989 Kuznetz
4,825,565 A 5/1989 Bigolin
4,939,851 A 7/1990 Miller
5,035,068 A 7/1991 Biasi
5,044,096 A 9/1991 Polegato (Continued)

OTHER PUBLICATIONS

Le Cycle, No. 332, p. 9, Oct. 2004, France.

(Continued)

*Primary Examiner*—Jila M Mohandesi
(74) *Attorney, Agent, or Firm*—Ogilvy Renault, LLP

(57) ABSTRACT

The ventilated shoe comprises an outer sole and at least two interchangeable inner soles. The inner sole in disposed in contact with and over the outer sole. The outer sole has ventilation ports at the toe portion and at the heel portion. The ventilation ports extend through the entire thickness of the outer sole. A support is provided to spacedly rest the inner sole over the outer sole in a manner to allow air to penetrate through the ventilation ports and to circulate between the outer sole and the inner sole. The inner sole may be air permeable and is used when the temperature is medium to high. Under cold temperature it is preferable to use an impermeable inner sole.

15 Claims, 6 Drawing Sheets

U.S. PATENT DOCUMENTS

| | | | |
|---|---|---|---|
| 5,138,775 | A | 8/1992 | Chu |
| 5,261,169 | A | 11/1993 | Williford |
| 5,388,349 | A | 2/1995 | Ogden |
| 5,477,626 | A | 12/1995 | Kwon |
| 5,505,010 | A | 4/1996 | Fukuoka |
| 5,619,809 | A | 4/1997 | Sessa |
| 5,799,413 | A | 9/1998 | Argyris |
| 5,845,418 | A | 12/1998 | Chi |
| 5,845,421 | A | 12/1998 | Tanaka |
| 5,953,835 | A | 9/1999 | Kwon |
| 5,979,076 | A | 11/1999 | Li |
| 6,092,305 | A | 7/2000 | Troy et al. |
| 6,141,890 | A | 11/2000 | Chtn |
| 6,305,099 | B1 | 10/2001 | Chu |
| 6,305,100 | B1 | 10/2001 | Komarnycky et al. |
| 6,321,469 | B1 | 11/2001 | Cretinon |
| 6,477,793 | B1 | 11/2002 | Pruitt et al. |
| 6,625,902 | B2 | 9/2003 | Yamamoto |
| 2001/0001903 | A1 | 5/2001 | Di Girolamo |
| 2002/0017036 | A1 | 2/2002 | Berger et al. |
| 2002/0017037 | A1 | 2/2002 | Hayashi et al. |

OTHER PUBLICATIONS

Bicycle Retailer & Industry News, p. 37, Aug. 15, 2005, www.bicycleretailer.com.

BICYCLE SHOE WITH VENTILATING SOLE

CROSS-REFERENCE TO RELATED APPLICATIONS

This application is a continuation of U.S. patent application Ser. No. 10/209,003 filed Aug. 1, 2002, now pending, the specification of which is hereby incorporated by reference.

BACKGROUND OF THE INVENTION a) Field of the Invention

The present invention relates to a ventilated shoe. More particularly, the invention is concerned with a shoe that is adapted for use by a person when riding a bicycle and that is provided with a arrangement of outer and inner soles that permits air to circulate therebetween for improved comfort of the foot. According to one preferred embodiment, the ventilating air is permitted to reach the foot of the cyclist when the temperature is elevated, while according to another embodiment, ventilating air is prevented to reach the foot under cold temperature, its circulation being restricted to the inner space between the inner and outer soles.

b) Description of Prior Art

Cycling is an activity of increasing popularity. For a person who practices this sport to a limited extent, the equipment that is necessary is restricted, it being often only necessary to wear a helmet when it is required by local laws. However, for those who get deeply involved into this physical activity, for example long distance rides or trail cycling, some additional pieces of equipment are required, including especially designed cycling shoes. It will be understood that for such a demanding physical exercise, comfort of the foot is an essential condition.

It is known in the prior art to provide bicycle shoes that are vented for a better comfort of the foot. For example, U.S. Pat. No. 4,679,335 discloses a vented bicycle shoe comprising air scoops at the front of the shoe that direct air to channels formed in the inner base of the shoe and extend toward the heel. This design allegedly provides a cooling action on the foot of the cyclist.

Another example of bicyclist shoe that provides ventilation is U.S. Pat. No. 4,825,565. According to this patent, the sole body is formed with vent openings at the face of the body that directs air through dual channels provided in the upper face of the sole, the channels extending rearwardly near the side edges of the sole.

It is not believed that the above patents defined ventilated cyclist shoes that provide sufficient comfort to the cyclist's foot.

SUMMARY OF THE INVENTION

It is an object of the present invention to provide a ventilated shoe for cyclist that provides comfort notwithstanding the outside temperature.

It is another object of the present invention to provide a combination of inner and outer soles for a cyclist shoe that permits a good ventilation while exhausting foot heat and humidity from the shoe.

The above and other objects of the present invention may be achieved by providing a ventilated shoe for use by a person when riding a bicycle, comprising an outer sole having a toe portion, a heel portion and an arch portion separating the toe portion from the heel portion, and an inner sole disposed in contact with and over the outer sole. The outer sole has an outer face and an inner face, first ventilation ports are provided at the toe portion of the outer sole and second ventilation ports are provided at the heel portion of the outer sole. The first and second ventilation ports extend through the entire thickness of the outer sole. Support means are provided to spacedly rest the inner sole over the inner face of the outer sole and means are provided to allow air to penetrate through the ventilation ports. The support means are arranged to cause air to circulate between the outer sole and the inner sole.

One aspect of the invention provides a cycling shoe comprising: an upper portion defining an inner space sized and shaped to receive a foot of a rider therein; an outer sole mounted to the upper portion and having an inner face, an outer face, a toe section, and a heel section, the outer sole having at least one toe ventilation port in the toe section, the at least one toe ventilation port extending though the outer sole between the outer face and the inner face and providing an air input in the toe section, and at least one heel ventilation port in the heel section, the at least one heel ventilation port extending through the outer sole between the outer face and the inner face and providing an air input in the heel section; and an inner sole insertable in the inner space and superposable to the inner face of the outer sole, the inner sole cooperating with the at least one toe ventilation port and the at least one heel ventilation port for providing a continuous airflow between the toe section and the heel section by defining at least one continuous air channel extending longitudinally between the inner face of the outer sole and a lower face of the inner sole and in fluid communication with at least one of the toe ventilation port and at least one of the heel ventilation port.

Another aspect of the invention provides a cycling shoe comprising: an upper portion defining an inner space sized and shaped to receive a foot of a rider therein; an outer sole mounted to the upper portion and having a toe section, a heel section, an inner face, and an outer face, the heel section including at least one ventilation port extending through the outer sole with an inner end on the inner face and an outer end on the outer face, the ventilation ports providing fluid communication between the inner space and the exterior of the cycling shoe in both the toe section and the heel section, the outer end of the ventilations ports being spaced from a substantially flat surface when the cycling shoe lies thereto: and an inner sole insertable in the inner space, superposable to the outer sole and defining a continuous ventilation channel with the outer sole, the aeration channel being in fluid conununication with the at least one ventilation port and extending longitudinally between the inner face of the outer sole and a lower face of the inner sole, the at least one ventilation port and the ventilation channel defining a linear aeration pattern along a longitudinal axis of the outer sole.

Another aspect of the invention provides a cycling kit. The cycling kit comprises: a cycling shoe having an upper portion defining an inner space sized and shaped to receive a foot of a rider therein and an outer sole mounted to the upper portion and having an outer face with at least one ventilation port providing a fluid communication between the inner space and the exterior of the cycling shoe; a first inner sole insertable in the inner space and juxtaposable over the outer sole, the first inner sole being provided with apertures therein, at least one of the apertures being influid communication with the at least one ventilation port of the outer sole when the first inner sole is juxtaposed thereto; and a second inner sole insertable in the inner space and juxtaposable over the outer sole, the second inner sole fully covering the at least one ventilation port of the outer sole when the second inner sole is juxtaposed thereto and substantially preventing fluid communication between the at least one ventilation port of the outer sole and the inner space above the second inner sole.

A further aspect of the invention provides a cycling shoe comprising: an upper portion defining an inner space sized and shaped to receive a foot of a rider therein; an outer sole mounted to the upper portion and having a toe section and a heel section, the heel section including at least two ventilation ports therein disposed in a linear aeration pattern along a longitudinal axis of the outer sole, the ventilation ports providing fluid communication between the inner space and the exterior of the cycling shoe; and an inner sole insertable in the inner space and juxtaposable over the outer sole, the ventilation ports of the outer sole cooperating with the inner sole and providing a linear aeration flow in the heel section of the inner space between the ventilation ports with the at least two ventilation ports of the heel section being in fluid communication through a ventilation channel extending longitudinally between the outer sole and a lower face of the superposed inner sole.

BRIEF DESCRIPTION OF DRAWINGS

The invention will be better understood with reference to preferred embodiments which are illustrated without limitation in the annexed drawings, in which.

DESCRIPTION OF PREFERRED EMBODIMENTS

Figure 1:
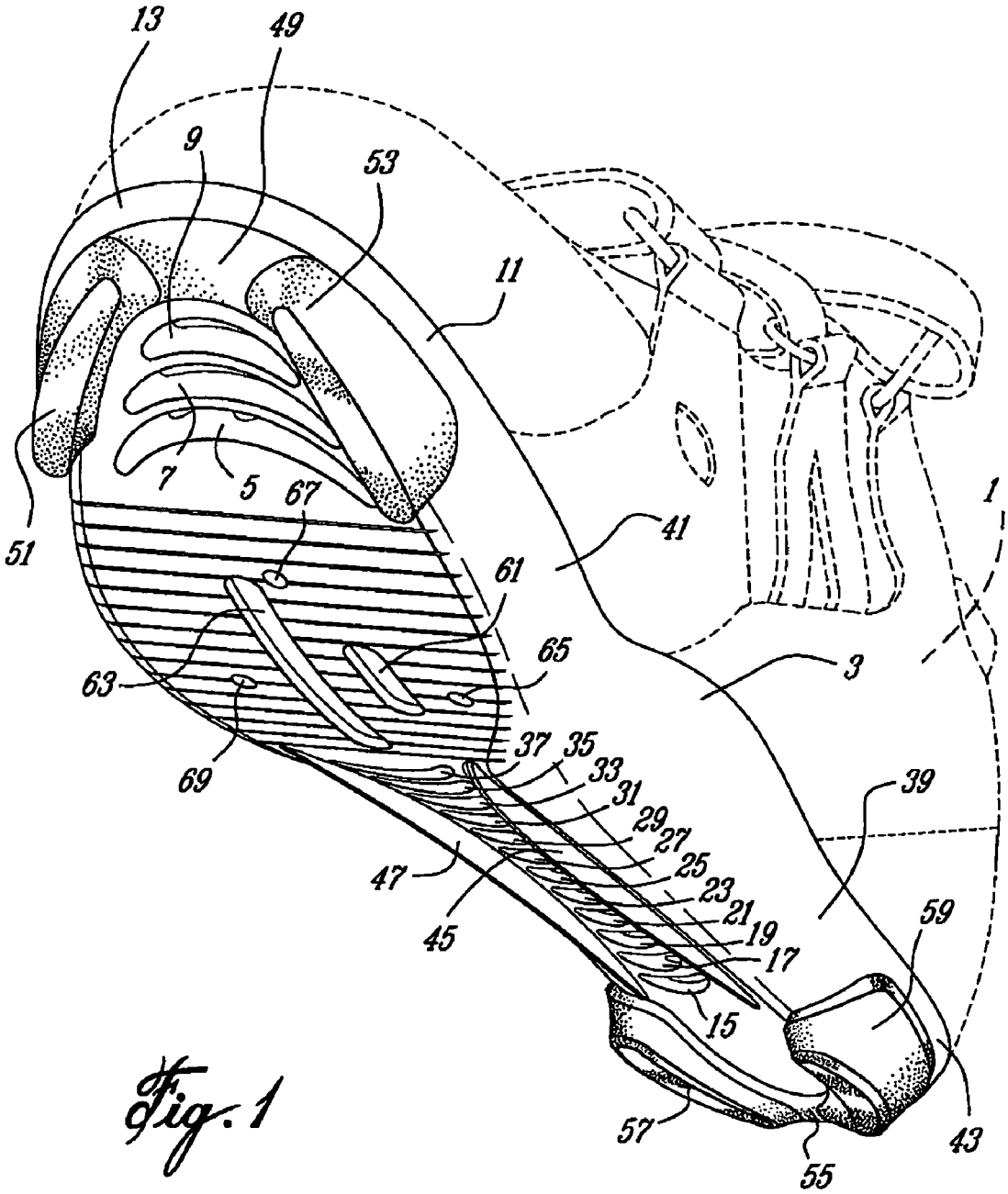
FIG. 1 is a perspective view of a ventilated shoe according to the invention, particularly illustrating the outer sole.
Figure 2:
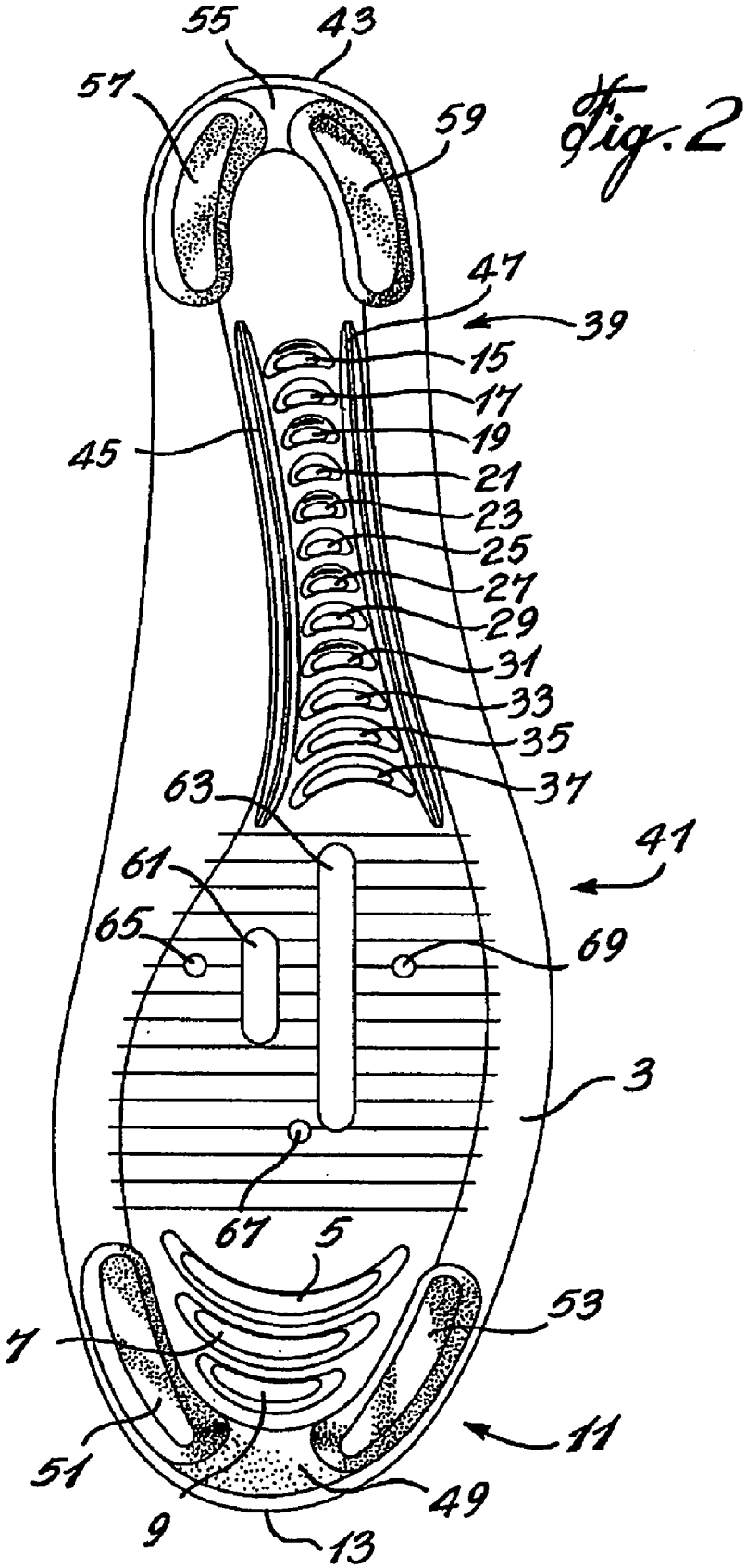
FIG. 2 is a plane view showing the outer face of the outer sole.
Figure 3:
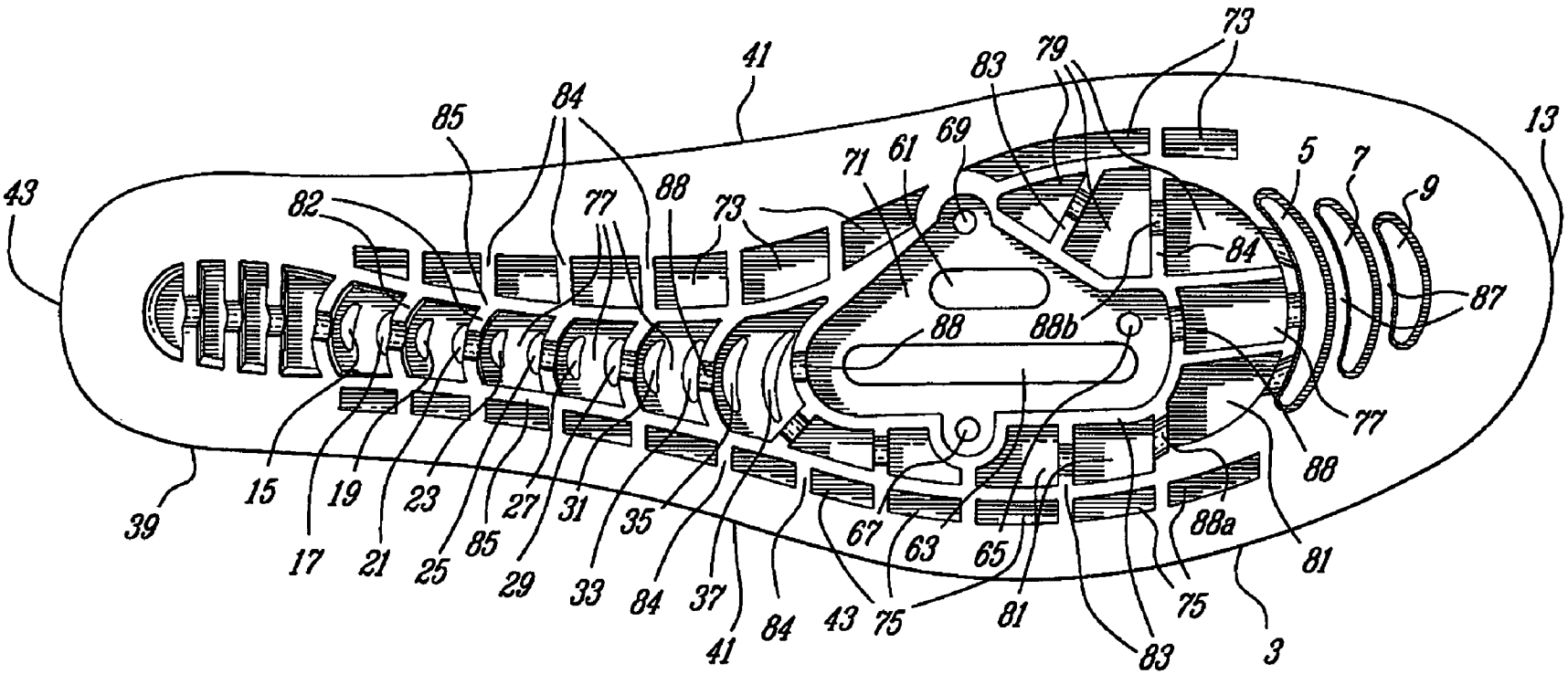
FIG. 3 is a plane view showing the inner face of the outer sole.

With reference to the drawings, particularly FIGS. 1, 2 and 3, it will be seen that a ventilated cycling shoe according to the invention comprises a standard shoe upper 1 illustrated in dotted lines in FIG. 1, and an outer sole 3. The ventilated shoe that is illustrated additionally comprises two interchangeable inner soles that are not shown in FIGS. 1, 2 and 3, and that will be used alternately depending on the outside temperature. These inner soles will be described in detail with reference to FIGS. 4 to 7.

Figure 6:
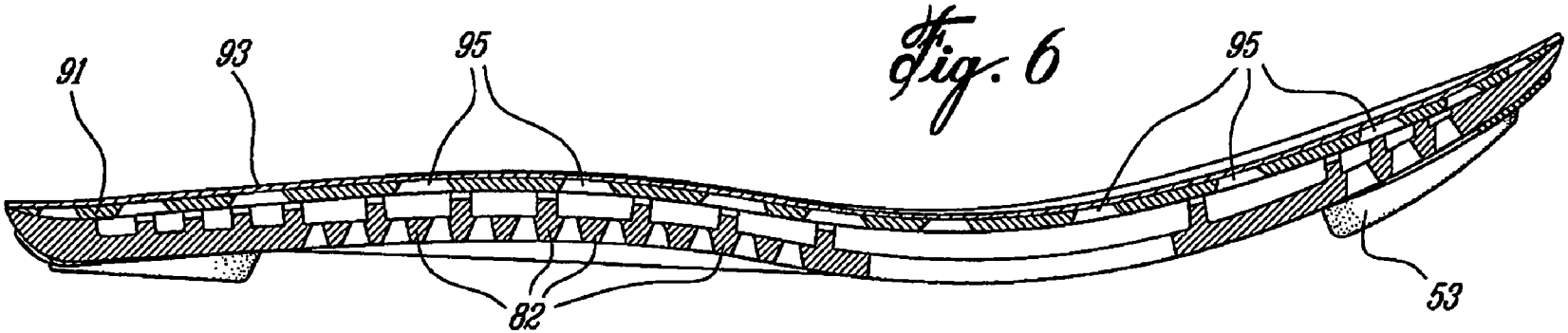
FIG. 6 is a longitudinal view in elevation of an inner sole according to one preferred embodiment, as disposed over the outer sole.
Figure 7:
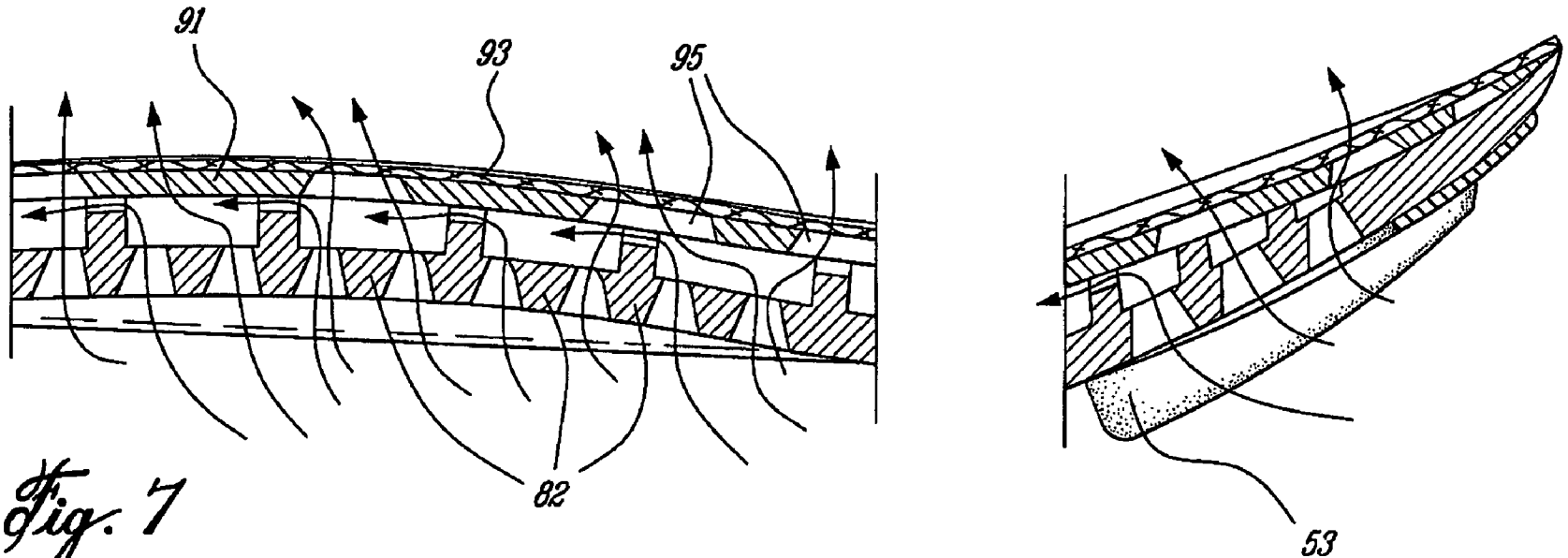
FIG. 7 is an enlarged view of the combination illustrated in FIG. 6 showing air circulation therethrough and therebetween.

Outer sole 3 is manufactured preferably by moulding a hard plastic material and is fixed in known manner to shoe upper 1 as will be appreciated by one skilled in the art. The outer face of outer sole 3 will now be described with particular reference to FIGS. 1 and 2. A series of three ventilation ports in the form of arcuate channels 5, 7 and 9 that extend throughout the entire thickness of outer sole 3, as shown in FIGS. 6 and 7 are provided in the toe portion 11 of the outer sole. As seen in FIG. 3, it will be noted that arcuate channels 5, 7 and 9 curve in an orientation that is similar to curving front end 13 of outer sole 3.

Outer sole 3 is also provided with a second series of ventilation ports in the form of twelve arcuate channels 15, 17, 19, 21, 23, 25, 27, 29, 31, 33, 35, and 37 that extend from heel portion 39 to arch portion 41 of outer sole 3. It will also be realised that arcuate channels, referred to above, curve in an orientation that is similar to curving rear end 43 of outer sole 3. Of course the number of arcuate channels 5, 7, 9 and 15, 17, 19, 21, 23, 25, 27, 29, 31, 33, 35, and 37 may vary to a large extent depending on the size of the outer sole and the quantity of air that is intended to be circulated between the outer and inner soles and inside the shoe, as will be appreciated by the skilled designer.

The outer face of outer sole 3 is completed by a pair of curving ribs 45, 47 that follow both sides of the alignment of arcuate channels 15-37. Also provided on the outer face of outer sole 3, are a toe support member 49 that comprises a pair of stud members 51, 53 as shown in FIGS. 1 and 2, and a heel support member 55 that comprises a pair of stud members 57, 59. As shown, toe support member 49 is fixed in known manner at the front end of outer sole 3 in toe portion 11 thereof. Similarly, heel support member 55 is also fixed in known manner, at the rear end of outer sole 3 in heel portion 39 thereof.

Slots 61 and 63 and holes 65, 67 and 69 (which form no part of the present invention) are provided as in any known cycling shoe to mount a bracket (not shown) for attachment to pedals.

Turning now to the inner face of outer sole 3 it will be seen that it is formed with a plurality of depressions of various geometrical configurations, generally four sided, that will now be described more in detail. However, beforehand, it will be noted that there is a larger depression 71, generally of triangular shape for mounting the bracket mentioned above. It will also be noted that the depressions are distributed and arranged to define longitudinal and transverse ridges as well as arcuate ridges. More particularly, from front to rear, starting past the three arcuate channels 5, 7, and 9, there are provided lateral depression 73 and 75 central depressions 77 as well as intermediate depressions 79 and 81, the latter intermediate depressions generally surrounding larger depression 71. As shown, the above mentioned depressions define central, intermediate and outer transverse ridges 82, 83 and 84 as well as longitudinal ridges 85. In addition, arcuate ridges 87 are formed by arcuate channels 5, 7 and 9. The above ridges 83, 84, 85 and 87 will serve to support inner soles that will, be described later while providing voids defined by said depressions, between the inner and outer soles, as particularly shown in FIGS. 6 and 7, that will be described more in detail later.

With reference again to FIG. 3 central and intermediate ridges 82 and 83 are formed with rounded recesses 88, **88*a* and 88*b*, that are respectively aligned to define three air ducts between inner sole 89**, when the inner soles are placed over the outer sole.

Figure 4:
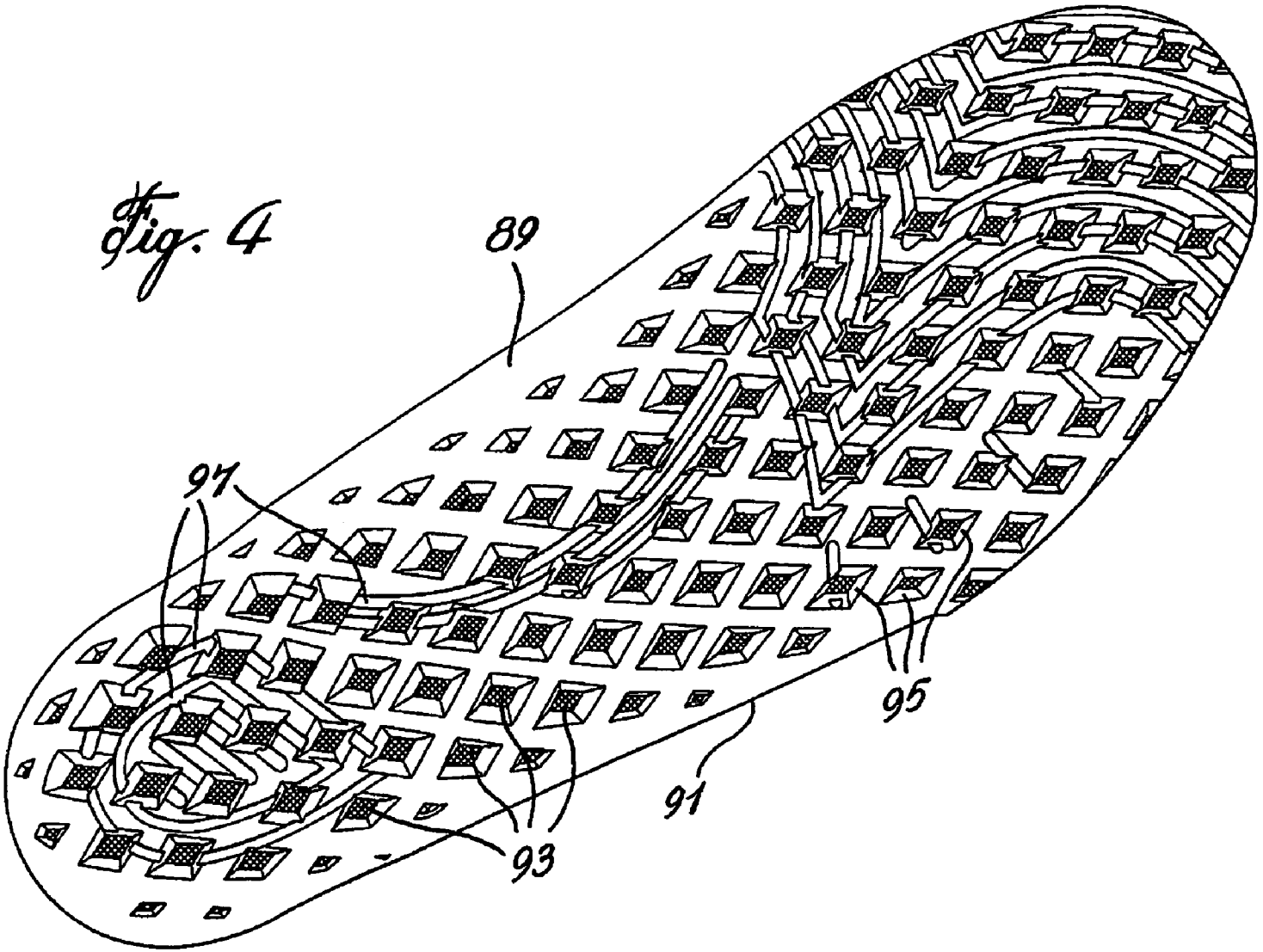
FIG. 4 is a plane view of the inner face of an inner sole according to one preferred embodiment that is air permeable.

As mentioned above, a ventilated shoe according to the invention also comprises an inner sole. In the embodiment illustrated in FIG. 4 inner sole 89 is intended to allow air circulation between inner and outer soles 3 and 89 while at the same time allowing circulated air to reach the inside of the shoe to comfort and cool the foot of the cyclist, when the outside temperature is medium to high. More particularly, with reference to FIG. 4, inner sole 89 comprises a layer of elastomeric material 91 and a layer of a grid material 93 that is laminated in known manner to the layer of elastomeric material. As shown particularly in FIGS. 4, 6 and 7, elastomeric layer 91 is provided with a plurality of outwardly flaring openings 95 that easily allow circulated air to reach layer 93 of grid material and penetrate inside the shoe for refreshing and cooling comfort. With particular reference to FIG. 4, it will be seen that the elastomeric layer is also formed with an arrangement of grooves 97 that facilitate air circulation between inner sole 89 and outer sole 3. This embodiment is particularly useful when the outside temperature is medium to high.

Figure 5:
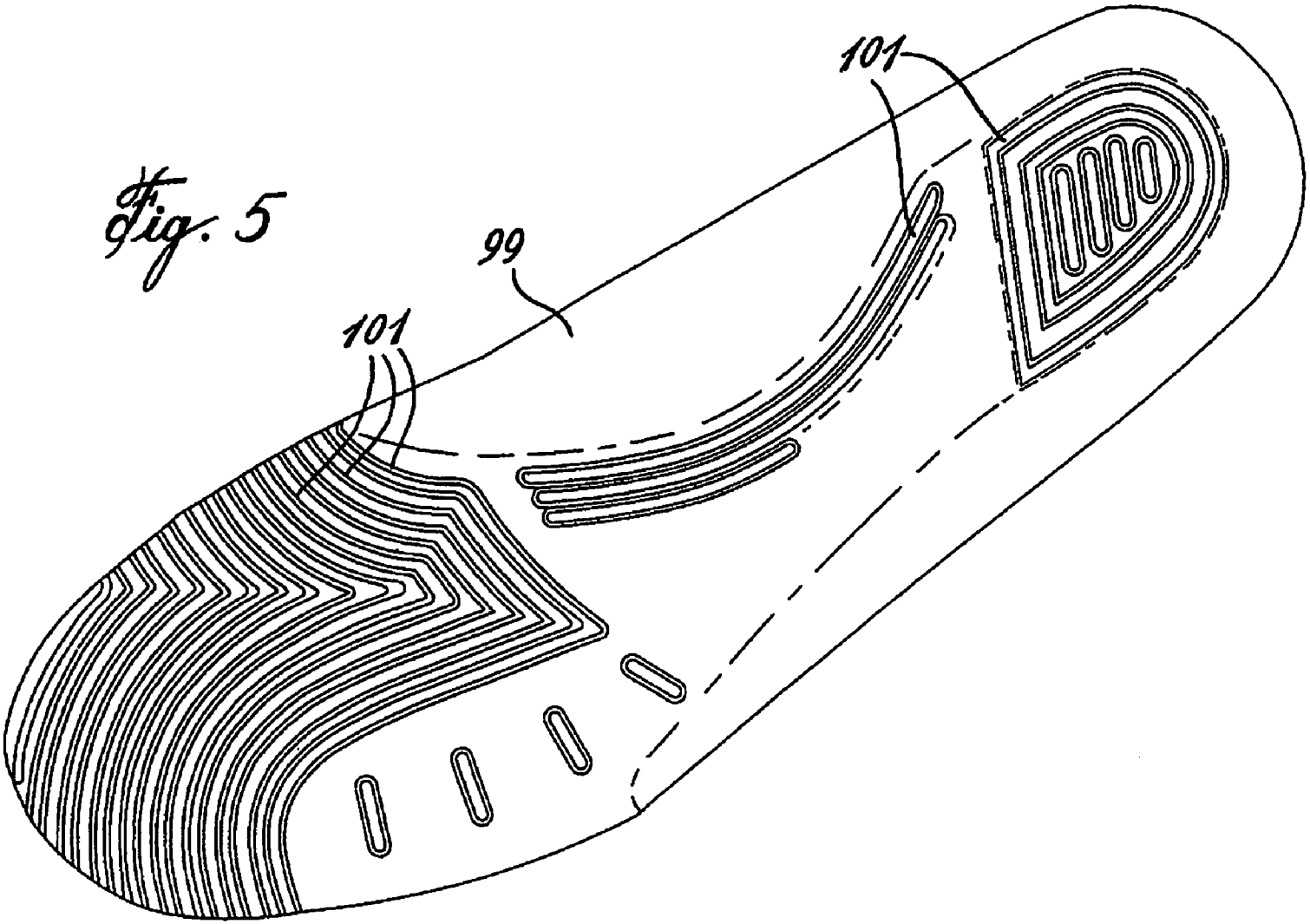
FIG. 5 is a plane view of the inner face of an inner sole according to another preferred embodiment, that is air impermeable.

Turning now to the embodiment illustrated in FIG. 5, the latter consists of an air impermeable inner sole 99 which is preferably made of a layer of elastomeric material. For better comfort, this layer of elastomeric material is laminated with a layer of foam material (not shown in the drawings) and the latter is laminated with a grid material (again not shown). On the inner face of inner sole 99 there are provided channels 101 that are distributed an arranged to spread circulated air through the entire space between inner sole 99 and outer sole 3.

Although the invention has been described with reference to preferred embodiments it is understood that modifications are possible as provided for in appended claims.

What is claimed is:

1. A cycling shoe comprising:

an upper portion defining an inner space sized and shaped to receive a foot of a rider therein;

an outer sole mounted to the upper portion and having an inner face, an outer face, a toe section, and a heel section, the outer sole having at least one toe ventilation port in the toe section, the at least one toe ventilation port extending through the outer sole between the outer face and the inner face and providing an air input in the toe section, and at least one heel ventilation port in the heel section, the at least one heel ventilation port extending through the outer sole between the outer face and the inner face and providing an air input in the heel section; and an inner sole insertable in the inner space and superposable to the inner face of the outer sole, the inner sole cooperating with the at least one toe ventilation port and the at least one heel ventilation port for providing a continuous airflow between the toe section and the heel section by defining at least one continuous air channel extending longitudinally between the inner face of the outer sole and a lower face of the inner sole and in fluid communication with at least one of the toe ventilation port and at least one of the heel ventilation port.

2. A cycling shoe as claimed in claim 1, wherein the at least one heel ventilation port has an outer end on the outer face and an air gap is provided between the outer end of the at least one heel ventilation port and a substantially flat surface on which the cycling shoe is disposed for preventing the obstruction of the at least one heel ventilation port.

3. A cycling shoe as claimed in claim 2, wherein the outer sole comprises a cleat mounting section separating the toe section and the heel section, a heel end, and a toe end and has a waved shape, the cleat mounting section and the heel end abutting the substantially flat surface on which the cycling shoe is disposed.

4. A cycling shoe as claimed in claim 1, wherein the inner sole comprises a lower face juxtaposable to the inner face of the outer sole and wherein at least one of the inner face of the outer sole and the lower face of the inner sole comprises at least one longitudinally extending groove in fluid communication with the at least one toe ventilation port and the at least one heel ventilation port.

5. A cycling shoe as claimed in claim 1, comprising a first inner sole insertable in the inner space and juxtaposable over the inner face of the outer sole, the first inner sole having a layer of elastomeric material and a layer of grid material laminated to the layer of elastomeric material, the layer of elastomeric material having openings allowing air to pass therethrough and through the grid material, the openings being in fluid communication with at least one of the at least one toe ventilation port and the at least one heel ventilation port when juxtaposed to the outer sole and providing an air flow between the exterior of the cycling shoe and the inner space through the outer sole and the inner sole.

6. A cycling shoe comprising:

an upper portion defining an inner space sized and shaped to receive a foot of a rider therein;

an outer sole mounted to the upper portion and having a toe section, a heel section, an inner face, and an outer face, the heel section including at least two ventilation ports extending through the outer sole with an inner end on the inner face and an outer end on the outer face, the ventilation ports providing fluid communication between the inner space and the exterior of the cycling shoe in both the toe section and the heel section, the outer ends of the ventilations ports being spaced from a substantially flat surface when the cycling shoe lies thereto; and an inner sole insertable in the inner space, superposable to the outer sole and defining a continuous ventilation channel with the outer sole, the aeration channel being in fluid communication with the at least two ventilation ports and extending longitudinally between the inner face of the outer sole and a lower face of the inner sole, the at least two ventilation ports and the ventilation channel defining a linear aeration pattern along a longitudinal axis of the outer sole.

7. A cycling shoe as claimed in claim 6, wherein the outer sole comprises a cleat mounting section, a heel end, and a toe end, the cleat mounting section separating the toe section and the heel section and adapted for mounting a cleat thereto, the outer sole having a waved shape permitting the cleat mounting section and the heel end to abut the substantially flat surface and the outer ends of the ventilation ports to be spaced from the substantially flat surface when the cycling shoe lies thereto.

8. A cycling shoe as claimed in claim 6, wherein the outer sole comprises at least one ventilation port in the toe section and the inner sole cooperates with the ventilation ports in the toe and the heel sections for providing an airflow in the inner space between the toe section and the heel section by defining at least one air channel between the outer sole and the inner sole.

9. A cycling shoe as claimed in claim 8, wherein the inner sole comprises a lower face juxtaposable to the inner face of the outer sole and at least one of the inner face of the outer sole and the lower face of the inner sole comprising at least one longitudinally extending groove in fluid communication with the ventilation ports and providing an air flow between the toe section and the heel section.

10. A cycling shoe comprising:

an upper portion defining an inner space sized and shaped to receive a foot of a rider therein;

an outer sole mounted to the upper portion and having a toe section and a heel section, the heel section including at least two ventilation ports therein disposed in a linear aeration pattern along a longitudinal axis of the outer sole, the ventilation ports providing fluid communication between the inner space and the exterior of the cycling shoe; and an inner sole insertable in the inner space and juxtaposable over the outer sole, the ventilation ports of the outer sole cooperating with the inner sole and providing a linear aeration flow in the heel section of the inner space between the ventilation ports with the at least two ventilation ports of the heel section being in fluid communication through a ventilation channel extending longitudinally between the outer sole and a lower face of the superposed inner sole.

11. A cycling shoe as claimed in claim 10, wherein the toe section of the outer sole comprises at least one ventilation port providing fluid communication between the inner space and the exterior of the cycling shoe.

12. A cycling shoe as claimed in claim 11, wherein the at least one ventilation port in the toe section and the ventilations ports of the heel section cooperates with the inner sole to provide an air flow in the inner space between the toe section and the heel section by defining at least one air channel between the outer sole and the inner sole.

13. A cycling shoe as claimed in claim 10, wherein the outer sole comprises an inner face and the inner sole comprises a lower face juxtaposable to the inner face of the outer sole and wherein at least one of the inner face of the outer sole and the lower face of the inner sole comprises at least one longitudinally extending groove in fluid communication with the ventilation ports of the toe section and the heel section.

14. A cycling shoe as claimed in claim 10, wherein the outer sole comprises an outer face with two longitudinally extending ribs, each longitudinally extending rib protruding outwardly from the outer face and extending on a respective side of the at least two ventilation ports in the heel section.

15. A cycling shoe as claimed in claim 10, wherein the at least two ventilation ports in the heel section have an outer end on an outer face of the outer sole, the outer ends of the at least two ventilation ports in the heel section being spaced from a substantially flat surface on which the cycling shoe lies.

* * * * *